US008303769B2

(12) United States Patent
Engelfeldt et al.

(10) Patent No.: US 8,303,769 B2
(45) Date of Patent: Nov. 6, 2012

(54) ARRANGEMENT, SYSTEM AND METHOD FOR TREATMENT OF CELLULOSE PULP

(75) Inventors: Andreas Engelfeldt, Alnö (SE); Bertil Ernerfeldt, Njurunda (SE); David Lindkvist, Alnö (SE)

(73) Assignee: Metso Paper, Inc. (FI)

( * ) Notice: Subject to any disclaimer, the term of this patent is extended or adjusted under 35 U.S.C. 154(b) by 0 days.

(21) Appl. No.: 13/256,847

(22) PCT Filed: Mar. 9, 2010

(86) PCT No.: PCT/SE2010/050266
§ 371 (c)(1),
(2), (4) Date: Sep. 15, 2011

(87) PCT Pub. No.: WO2010/107369
PCT Pub. Date: Sep. 23, 2010

(65) Prior Publication Data

US 2012/0000619 A1 Jan. 5, 2012

(30) Foreign Application Priority Data

Mar. 19, 2009 (SE) ..... 0900351

(51) Int. Cl.
*D21C 9/08* (2006.01)

(52) U.S. Cl. ..... 162/55; 162/242; 162/246

(58) Field of Classification Search ..... 162/55, 162/242, 246, 251, 380, 190
See application file for complete search history.

(56) References Cited

U.S. PATENT DOCUMENTS 2,364,171 A 12/1944 Staege
5,622,267 A 4/1997 Hautala
2004/0011483 A1* 1/2004 Hautala et al. ..... 162/20

FOREIGN PATENT DOCUMENTS

| | | | |
|---|---|---|---|
| EP | 0649940 | A1 | 4/1995 |
| EP | 1126076 | A2 | 8/2001 |
| EP | 1165882 | A1 | 1/2002 |
| SE | 515574 | C2 | 9/2001 |
| WO | 85/04433 | A1 | 10/1985 |
| WO | 00/58549 | A1 | 10/2000 |

OTHER PUBLICATIONS

International Search Report, PCT/SE2010/050266, dated Jun. 20, 2010.

* cited by examiner

*Primary Examiner* — Mark Halpern
(74) *Attorney, Agent, or Firm* — Lerner, David, Littenberg, Krumholz & Mentlik, LLP

(57) ABSTRACT

Apparatus for screening cellulose pulp streams is disclosed including first and second screens contained in a housing, and a primary inlet for directing the cellulose pulp stream into the housing, an accept outlet for withdrawing an accept portion from the housing, a reject outlet for withdrawing a reject portion from the housing, a first accept chamber for receiving the accept portion which has passed through the first screen, a second screen chamber for directing the first accept portion to the second screen, and a secondary pulp inlet for receiving a second cellulose pulp feed stream comprising a screened cellulose pulp accept fraction and directing it to the second screen whereby the second accept fraction is delivered to the accept outlet. Methods and systems for screening cellulose pulp systems are also disclosed.

17 Claims, 5 Drawing Sheets

ARRANGEMENT, SYSTEM AND METHOD FOR TREATMENT OF CELLULOSE PULP

CROSS-REFERENCE TO RELATED APPLICATIONS

The present application is a national phase entry under 35 U.S.C. §371 of International Application No. PCT/SE2010/050266 filed Mar. 9, 2010, published in English, which claims priority from Swedish Application No. 0900351-8, filed Mar. 19, 2009, all of which are incorporated herein by reference.

FIELD OF THE INVENTION

The present invention relates to treatment of cellulose pulp and in particular to a screening arrangement for cellulose pulp and a system and a method for screening of cellulose pulp.

BACKGROUND OF THE INVENTION

In the course of preparing a cellulose pulp to be used for further processing, such as for example in papermaking or the like, a number of "standard" operations are often performed. For chemical pulp, lignin from wood chips is dissolved in a digester in order to separate the fibers within the wood chips from each other. The cooked pulp is then transported to washing and screening devices. During cooking, not all of the wood chips are equally well digested, and the resulting pulp thus contains not only individually separated fibers, but also pieces of uncooked wood chips, knots and fiber bundles known as shives. The shives, knots and other impurities (e.g. sand, bark, etc.) still remaining in the pulp may cause problems in later stages of the pulp processing, and thus need to be removed. There are a number of well-known operations used, separately or in combination, to separate impurities from the pulp, including sedimentation, screening and vortex cleaning operations.

Screening refers to an operation in which fibers in a pulp suspension pass through a perforated plate with holes or slots, while the impurities are retained. The fraction of pulp passing the plate is referred to as the accept fraction or simply the accept. The fraction of pulp not passing through the openings of the plate is referred to as the reject fraction or simply the reject. The pulp fraction fed to the perforated plate is referred to as the inject fraction or simply the inject. An inject can thus be said to be a pulp flow about to be divided into an accept and a reject. Instead of a perforated plate, slots for separation may be created in other ways, e.g. through forming a screen basket of longitudinal bars.

In a pulp mill, there are often several screening operations at different locations throughout the process. For example, there is often a primary screening operation, in connection with the pulp being washed and dewatered, and an after-screening operation after bleaching of the pulp. Each screening operation can, and often will be, performed in several stages. One single screening apparatus is often not sufficient to separate all impurities in one stage. In order to achieve good screening efficiency, the reject flow has to be sufficiently large to make sure that the impurities not passing through the screen are removed from the screening apparatus. In case the reject flow is too small, impurities may be retained in the screening chamber where they can cause unnecessary wear to the screen. Since the reject flow must therefore be of a certain magnitude, this implies that a large number of "good" fibers (i.e. fibers that would belong to the accept) is not given enough time to pass the perforated plate or through slots between longitudinal bars, but instead becomes a part of the reject. The accept portion from the screening stage is passed to the next processing step, while the reject portion is passed to a subsequent screening stage, in order to be screened again. In order to minimize fiber losses, the accept from the subsequent screening stage is then returned to the inject of the preceding screening stage. In that way, most of the "good" fibers are recovered.

There are several different kinds of screening apparatuses. One commonly used screening apparatus is a so-called combi-screen, meaning that two or more screening stages are combined within the same screen housing. An example of such an apparatus is disclosed in European Patent No. 1,165,882, where a first screening means is located at least partly within a second screening means. Combi-screens have been developed in order to provide a cheaper process in which two different screening apparatuses are combined into one apparatus, eliminating the need for e.g. a separate knotter. There are also other kinds of multistage screens in which several screening stages are combined within the same apparatus. For example, the separate screening stages may be arranged by means of screens on top of each other, or by one high screening basket being divided into separate screening sections While using a combi-screen, it is not possible to return the accept from a subsequent screening stage after the combi-screen to its directly preceding screening stage, such as e.g. a fine screen contained within the combi-screen. The accept portion from the subsequent screening stage (at this stage not containing any larger particles), when returned to a combi-screen, will have to pass both screening stages within the combi-screen again, which implies an unnecessary load on the coarse screen. Part of the pulp entering the coarse screen has then already been screened for larger impurities, and does not require the coarse screening stage. The return flow from the subsequent screening stage can submit to about 15-20% of the main flow into the combi-screen. This implies that the pump before the combi-screen must be dimensioned to handle a larger flow, in case the return flow is to be added before the pump. Even if the flow is added after the pump, the coarse screen still has to be dimensioned to be able to handle the larger flow. All of these measures render a more expensive process.

One object of the present invention is thus to provide an improved system and arrangement for the screening of cellulose pulp. Another object of the present invention is to achieve a more efficient way of screening while minimizing fiber losses, and at the same time keeping the number of individual screening apparatuses as low as possible, in order to minimize the total investment cost. Another object of the present invention is to provide a screening system and an arrangement where the screening means and associated equipment does not have to be overdimensioned, also in order to minimize the investment cost.

SUMMARY OF THE INVENTION

In accordance with the present invention, these and other objects have now been realized by the discovery of apparatus for screening a cellulose pulp stream comprising a housing, a first screen member contained within the housing including screen openings for permitting a first predetermined accept portion to pass therethrough and for creating a first reject portion, a second screen member contained within the housing including screen openings for permitting a second predetermined accept portion to pass therethrough and for creating a second reject portion, a primary inlet for directing the cellulose pulp stream into the housing, an accept outlet for withdrawing the second predetermined accept portion from the housing, a reject outlet for withdrawing at least one of the first and second reject portions from the housing, a first screening chamber for receiving the cellulose pulp stream from the primary inlet for transfer to the first screen member, a first accept chamber for receiving the first predetermined accept portion of the cellulose pulp stream which has passed through the first screen member, a second screen chamber for directing the first predetermined accept portion of the cellulose pulp stream from the first accept chamber to the second screen member, a secondary pulp inlet for receiving a second cellulosic pulp feed stream comprising a screened cellulose pulp accept fraction and directing the second cellulose pulp feed stream to the second screen member, whereby the second predetermined accept fraction is delivered to the accept outlet. In a preferred embodiment, the screen openings in the first screen member and the second screen member have different sizes.

In accordance with one embodiment of the apparatus of the present invention, the first and second screen members are coaxially disposed within each other within the housing, and the first screen member is rotatably mounted within the second screen member.

In accordance with another embodiment of the apparatus of the present invention, the screen openings in the first screen member comprise coarse screen openings and the screen openings in the second screen member comprise fine screen openings smaller than the coarse screen openings.

In accordance with another embodiment of the apparatus of the present invention, the second cellulose pulp feed stream merges with the first predetermined accept fraction before entering the second screen member.

In accordance with another embodiment of the apparatus of the present invention, the secondary pulp inlet is disposed in the lower portion of the housing.

In accordance with another embodiment of the apparatus of the present invention, the apparatus includes a secondary pulp inlet chamber for directing the secondary cellulose pulp feed stream from the secondary pulp inlet to the second screen member. In a preferred embodiment, the secondary pulp inlet is disposed in the lower portion of the housing below the first screen member, whereby the secondary cellulose pulp feed stream flows from the secondary pulp inlet into the secondary pulp inlet chamber from below. In another embodiment, the apparatus includes a bearing unit centrally disposed within the first screen member and a stator disposed between the first screen member and the bearing unit, the secondary pulp inlet chamber being disposed between the bearing unit and the stator. In a preferred embodiment, the secondary inlet chamber and the first accept chamber are connected to each other. In yet another embodiment, the secondary inlet is disposed in the largest diameter portion of the housing.

In accordance with another embodiment of the apparatus of the present invention, the secondary pulp inlet is disposed in the upper portion of the housing. In a preferred embodiment, the housing includes a cover, and the secondary pulp inlet is disposed in the cover.

In accordance with the present invention, a system has also provided including the apparatus set forth above, as well as a separate housing including a third screen member for screening a separate cellulose pulp stream and producing a third accept portion thereby, and conduit means for passing the third accept portion to the secondary pulp inlet. In a preferred embodiment, the secondary pulp inlet includes mixing means for mixing the third accept portion with the first predetermined accept portion for feeding into the second screen member.

In accordance with the present invention, a method has also been devised for screening a cellulose pulp stream in a housing including an inlet, a first screen member including screen openings for permitting a first predetermined accept portion to pass therethrough, and a second screen member including screen openings for admitting a second predetermined accept portion to pass therethrough, the method including directing the cellulose pulp stream into the inlet in the housing, directing the cellulose pulp stream from the inlet to the first screen member, screening the cellulose pulp stream in the first screen member to produce a first accept portion of the cellulose pulp stream and a first reject portion thereof, receiving the first accept portion of the cellulose pulp stream which has passed through the first screen member, screening the first accept portion of the cellulose pulp stream in the second stream member to produce a second accept portion of the cellulose pulp stream and a second reject portion thereof, withdrawing the second accept portion from the housing, withdrawing at least one of the first and second reject portions from the housing, providing a second cellulose pulp stream comprising a screened cellulose pulp stream, and directing the second cellulose pulp stream to the second screen member. In a preferred embodiment, the method includes mixing the second cellulose pulp feed stream with the first accept portion before screening in the second screen member.

In accordance with the present invention a screening arrangement, a system and a method for screening are proposed in which a fiber fraction can be returned from at least one subsequent screening arrangement to a first screening arrangement, the first screening arrangement being an arrangement in which at least two screening stages, e.g. a coarse screen and a fine screen, are combined in one apparatus in such a way that the returned fiber fraction or fiber fractions from the at least one subsequent screening arrangement enters as inject to a second screening means (e.g. a fine screen) of the first screening arrangement and is screened only through the second screening means of the first screening arrangement.

In accordance with the present invention an arrangement for screening of cellulose pulp in several stages is proposed comprising at least two screening means within the same apparatus, where the screening means have openings for allowing certain fractions of cellulose pulp to pass through the screens. The screening means are enclosed in a housing, and the arrangement further comprises a main inlet for input of pulp to the screening arrangement, at least one outlet for output of an accept fraction of pulp from the screening arrangement, and at least one outlet for output of a reject fraction. The arrangement further comprises a first screening chamber being arranged to receive pulp from the main inlet for input of pulp, a first accept chamber arranged to receive pulp passing through a first screening means and a second screening chamber arranged to receive pulp at least from the first accept chamber before screening through a second screening means, and the screening arrangement further comprises a secondary pulp inlet for input of pulp from a subsequent screening arrangement to be screened through the second screening means.

More specifically, in accordance with the present invention a screening arrangement, a system and a method for screening are provided in which the first screening arrangement is provided with a secondary pulp inlet separated from a main pulp inlet, and the secondary pulp inlet is arranged so that pulp entering the mentioned inlet is merged with the accept fraction of the first screening means in order to form an inject to be fed to the second screening means.

According to one embodiment of the present invention, the screening means are arranged co-axially and the first screening means is rotatably arranged at least partly within the second screening means. According to another embodiment, the size of the openings of the first and second screening means are different for the respective screening means.

According to another embodiment of the present invention, the first screening means is a coarse screen and the second screening means is a fine screen with openings smaller than the first screening means, and the main inlet for input of pulp is arranged so that the pulp from the main inlet is fed to the coarse screen.

The secondary pulp inlet may be arranged in the lower part of the screen, e.g. through a gable of the screen housing. Alternatively, the secondary pulp inlet may be arranged in the upper part of the screening arrangement, e.g. arranged to go through a cover of the housing enclosing the screening means.

According to another embodiment of the present invention, a secondary pulp inlet chamber is arranged to receive the pulp entering the secondary pulp inlet. The secondary pulp inlet can be arranged below the first screening means so that, in operation, a secondary pulp flow will enter the secondary inlet chamber from below. The secondary inlet chamber may be arranged, as seen in a circumferential direction, between a bearing unit centrally placed in the screening arrangement and a stator enclosed within the first screening means.

According to another embodiment of the present invention, the secondary inlet chamber and the first accept chamber are in connection with each other.

The secondary pulp inlet may consist of a connection piece arranged to fit within the largest diameter of the screening arrangement. In that way, any extra piping or the like sticking out of the screening arrangement is avoided. The screening arrangement thus maintains a compact design.

The present invention further relates to a system comprising a first screening arrangement as described above and further at least one subsequent screening arrangement, the respective screening arrangements being arranged, during operation, to allow an accept fraction/accept fractions of at least one subsequent screening arrangement to be returned to the first screening arrangement by means of the secondary pulp inlet. Several accept fractions from different subsequent screening arrangements could thus be returned to the first screening arrangement. According to a further embodiment of the system of the present invention, the secondary pulp inlet is arranged so as to enable mixing of the accept fraction from at least one subsequent screening arrangement with the accept fraction of the first screening means of the first screening arrangement to form an inject fraction to the second screening means of the first screening arrangement.

The present invention also relates to a method for screening a cellulose pulp suspension, using the system described above, in which an accept fraction from at least one subsequent screening arrangement is returned to an inject fraction to a second screening means of a first screening arrangement by means of a secondary pulp inlet, the accept fraction from the subsequent screening arrangement being screened only through the second screening means. It is to be understood that several accept fractions from different subsequent screening arrangements could be returned, as well as only the accept fraction of a particular subsequent screening arrangement. According to an embodiment of the method of the present invention, the accept portions of at least one of the subsequent screening arrangements and the first screening stage of the first screening arrangement are mixed before entering the second screening means.

BRIEF DESCRIPTION OF THE DRAWINGS

The present invention, together with further objects and advantages thereof, may best be understood by reference to the following detailed description which, in turn, refers to the appended drawings, in which.

DETAILED DESCRIPTION

Figure 1:
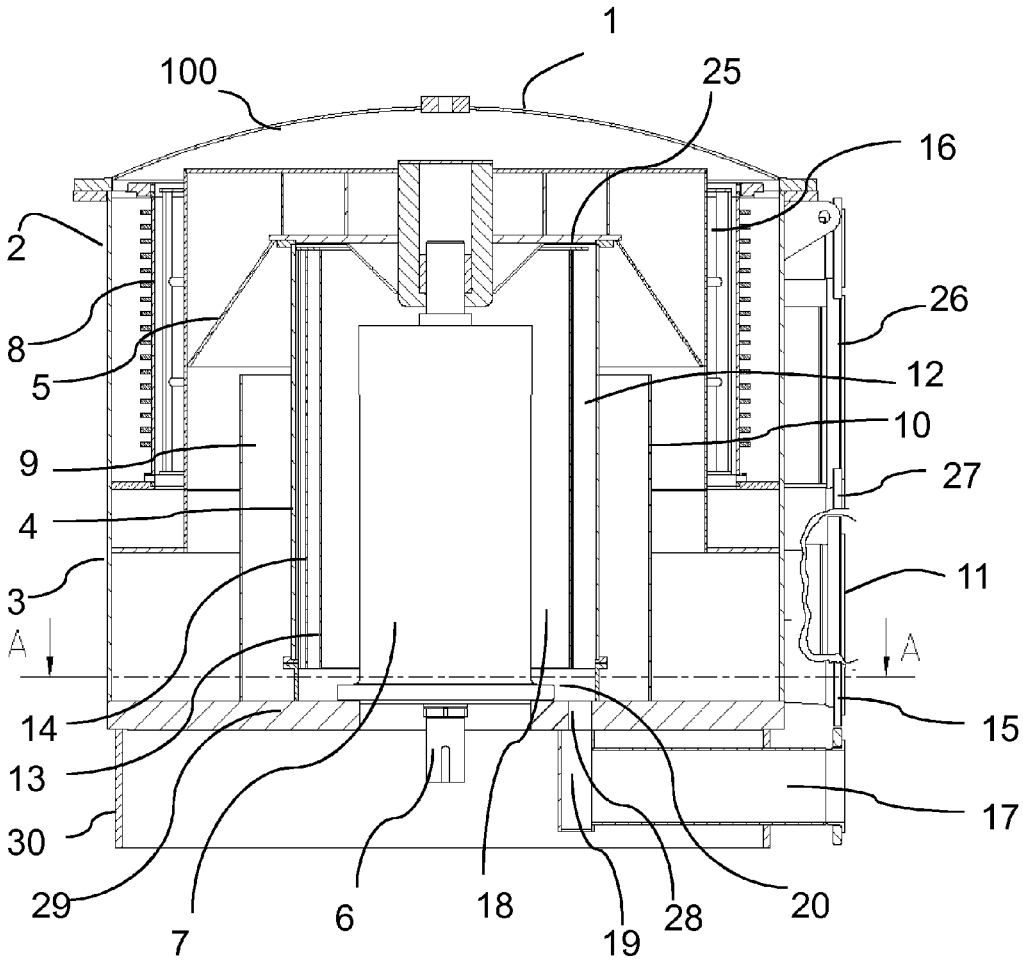
FIG. 1 is a side, elevational, schematic cross-sectional view of a screening arrangement according to a preferred embodiment of the present invention.

Referring to the drawings, similar or corresponding elements will be denoted by the same reference numbers. It should be noted that, although the following description primarily refers to a combined screening arrangement in which a fine screen is located outwardly of a coarse screen, seen from the center of the screening arrangement, the teachings are also applicable to "inside-out" arrangement, i.e. where the fine screen is located on the inside of the coarse screen. Inside-out arrangements with the coarse screen located on the outside of the fine screen hence lie within the scope of the present invention. It is also to be noted that the teachings are applicable to all kinds of such combi-screens combining a coarse screen and a fine screen within the same apparatus, as well as other multi-stage screens where several screening stages are performed in the same arrangement. The teachings hereof are thus applicable irrespective of whether the multi-stage screening apparatus contains a coarse screen or not. The screening means in the different stages may, for example, be of the same kind with openings of the same size. The screening means could also be located on the same diameter, i.e. on top of each other.

The screening apparatus 100 shown in FIG. 1 comprises a screen housing 1 with an upper portion 2 and a lower portion 3. The housing can preferably be pressurized. The lower portion 3 ends in a gable 29 which is placed on a frame 30. In the screen housing, a first screening means 4 is arranged on a rotor means 5 which is rotatable about a rotor shaft 6 contained in a bearing unit 7. The first screening means has a cylindrical shape and is located partially in the lower portion 3 of the screening arrangement. The first screening means 4 is arranged to rotate with the rotor means 5. A second screening means 8 is located in the upper portion 2 of the screening arrangement 100. The second screening means 8 is arranged coaxially with the first screening means 4 and has a greater diameter than the first screening means 4. At least a part of the first screening means 4 is arranged within at least a part of the second screening means 8. The first and second screening means may also be located vice versa. They may further be arranged on the same diameter, in that case none within the other but instead on top of each other.

A first screening chamber 9 is formed with a guide surface 10 being one limiting surface, outwardly in the circumferential direction, and the screening means 4 being the other, in the inward direction. The guide surface 10 is a cylindrical tubular means arranged coaxially with the first screening means 4, having a diameter larger than the first screening means 4 so that a space is formed between the screening means and the guide surface. The guide surface 10 is arranged to extend in an upward direction so that a substantial part of the first screening means 4 is surrounded by the guiding surface. This arrangement forces the pulp flow from a main pulp inlet 11 to enter the first screening chamber mainly in the vicinity of the upper part of the first screening means 4. In this way, a downward flow is created, which aids the reject flow since a reject from the first screening means 4 is to be taken out from the lower part of the screening arrangement through a first reject outlet 15.

In operation, a pulp flow to be screened enters the first screening chamber 9 through the main pulp inlet 11 and the pulp is then fed towards the first screening means 4. The pulp inlet in the illustrated embodiment is placed in the lower portion 3 of the screening arrangement, although near the middle of the screening arrangement. As previously described, the pulp is forced to flow upwardly due to the guide surface 10 in order for the pulp to enter the first screening means 4 at its uppermost location. Fibers of a size smaller than the size of the openings in the perforated screen plate pass through the screening means 4 and enter a first accept chamber 12. The accept chamber 12 is limited by the screening means 4 and by a stator 13 located inside the screening means 4. The stator is a stationary part, preferably cylindrical and provided with at least one pulse means 14. The pulse means 14 are arranged upon rotation of the rotary screening means 4 to create pressure pulses for clearing the first screening means 4. The screening is performed from the outside-in, which is preferable due to the centrifugal force preventing large and heavy particles from being in close contact with the screening means. This first screening stage can preferably perform the task of separating mainly larger impurities (e.g. knots), such a screening stage being commonly known as a knotter.

The reject portion, i.e. the particles not passing through the screen, is taken out through a reject outlet 15. This reject portion is also denoted the coarse reject in case the first screening means is a coarse screen. The accept fraction is further fed to a second screening chamber 16 to form an inject to the second screening means 8. The pulp passing the second screening means 8 is taken out through an accept outlet 26 while the reject portion is taken out through at least one reject outlet 27.

A secondary pulp inlet 17 is arranged so that pulp flowing through the secondary inlet is mixed with the accept portion from the first screening means 4 before entering the second screening means 8. The pulp entering the secondary inlet 17 consists of an accept fraction from a subsequent screening arrangement (not illustrated in this figure) in which the reject from the second screening means 8 has been screened again. The accept portion of the subsequent screening arrangement, together with the accept portion from the first screening means 4 in the screening arrangement 100, forms the inject to the second screening means 8. In this way, the "good fibers" contained in the reject portion from the second screening means 8 is brought back to the pulp flow moving along in the process and fiber losses are minimized.

Pulp from the secondary inlet 17 enters a secondary pulp inlet chamber 18. The secondary pulp inlet chamber 18 is limited inwardly, as seen in the circumferential direction, by the bearing unit 7 and outwardly by the stator 13. The secondary pulp inlet chamber 18 could also be arranged within the bearing unit 7, with the secondary inlet 17 placed below the bearing unit. In such a case, at least one opening will be provided in the outward wall of the bearing unit for transport of the pulp towards the second screening chamber 16. In the embodiment shown in FIG. 3, the secondary inlet chamber 18 at least partly coincides with the second screening chamber 16.

In a preferred embodiment of the present invention, the first screening means is a coarse screen and the second screening means is a fine screen. By the term coarse screen is meant a screen designed primarily to separate larger impurities such as knots. Typically the openings may be about 6-10 mm, normally about 8-10 mm in diameter. By the term fine screen is meant a screen designed to primarily separate skives from fibers. For a slotted fine screen, the slots may be in the range of about 0.15-0.60 mm, typically about 0.15-0.40 mm. Slots or holes may be used dependent on which process parameters are to be optimized.

Figure 2:
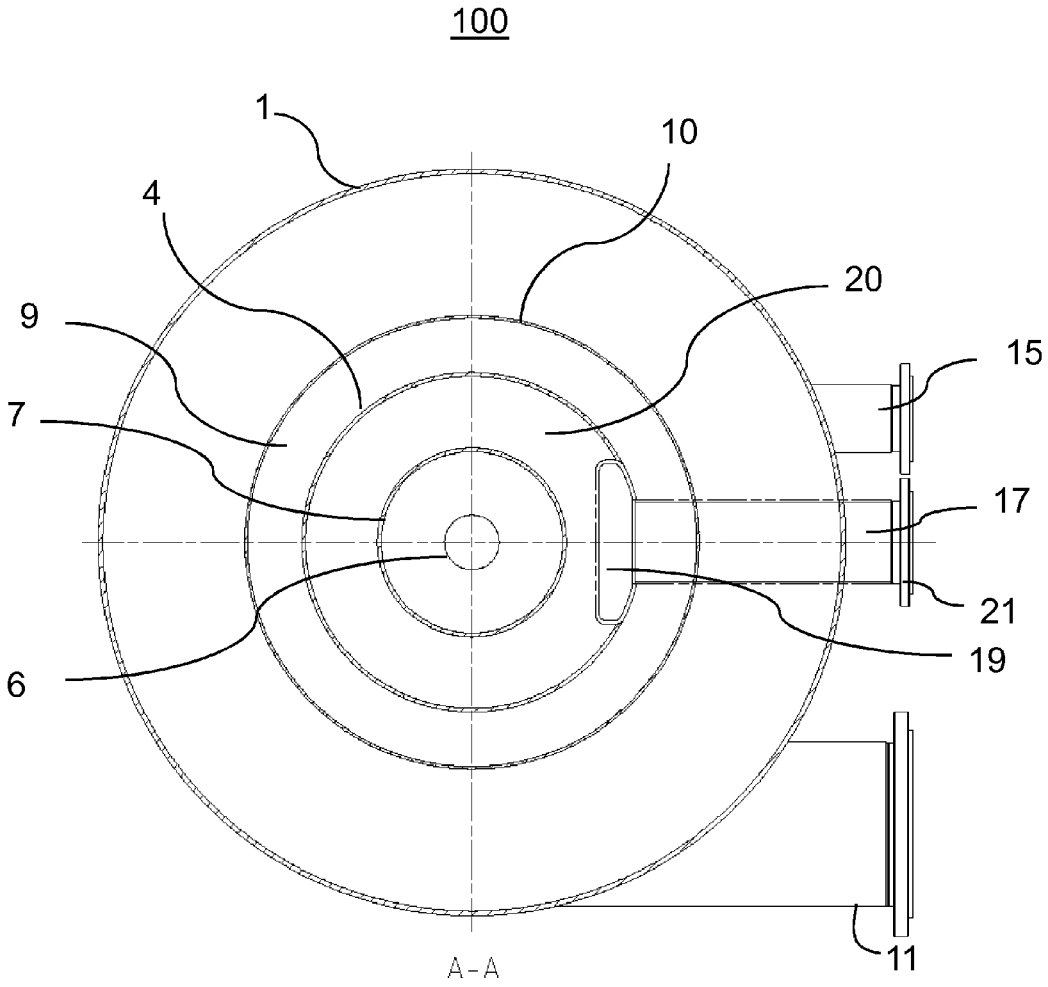
FIG. 2 is a top, elevational, transverse, cross-sectional view of the screening arrangement illustrated in FIG. 1, taken along cross-section A-A of FIG. 1.

In FIGS. 1 and 2 the secondary pulp inlet 17 is located in the lower portion of the screening apparatus 100, e.g. below the gable 29 of the screen housing 1. Preferably, the inlet consists of a connection piece adapted to fit within the largest diameter of the screening arrangement. This placement gives the advantage of eliminating any extra piping protruding from the screening arrangement. The secondary pulp inlet 17 is located in such a way that pulp flowing through the inlet is fed into the secondary inlet chamber 18. For example, the secondary pulp inlet 17 may be arranged to have an inlet opening 19 below an opening 28 in the gable 29 of the screen housing 1. From the secondary inlet chamber 18 the pulp is transported to the second screening chamber 16 to be passed through the second screening means 8. In one embodiment, the secondary inlet chamber 18 and the first accept chamber 12 are connected to each other at their respective lower portions by means of a connection portion 20, as well as at their respective upper portions by means of a second connection portion 25. At least a part of the accept from the first screening stage in the first screening arrangement can thus flow into the secondary inlet chamber 18 from below and merge with the accept from the subsequent screening stage of the second screening arrangement (not shown). A part of the accept from the first accept chamber 12 will enter the second screening chamber 16 directly, flowing upwardly in the screening arrangement. However, due to the connection portion the flow from the first accept chamber 12 going in an upward direction will also be at least partly mixed with the flow from the secondary inlet chamber 18 before entering the second screening chamber 16. Since the flow entering the secondary pulp inlet 17 and the flow in the first accept chamber 12 may differ in concentration, it is preferable to merge the flows before entering the second screening chamber in order to create a homogeneous flow to the second screening means 8.

FIG. 2 illustrates a cross-section A-A of a screening arrangement according to the embodiment shown in FIG. 1. The secondary pulp inlet 17 in this case is arranged as a connection piece comprising an outer connection flange 21 and an inner inlet opening 19. The inlet opening 19 is in communication with the secondary inlet chamber 18, and may also be in communication with the first accept chamber 12. In the figure the inlet opening is placed mainly underneath the first accept chamber 12. In this case, the first accept chamber 12 and the secondary inlet chamber 18 are in communication by means of the connection portion 20. The flow through the secondary pulp inlet 17 thus enters the secondary inlet chamber 18 through the connection portion 20. The inlet opening 19 may, however, be placed such that direct access is made to the secondary inlet chamber 18.

Figure 3:
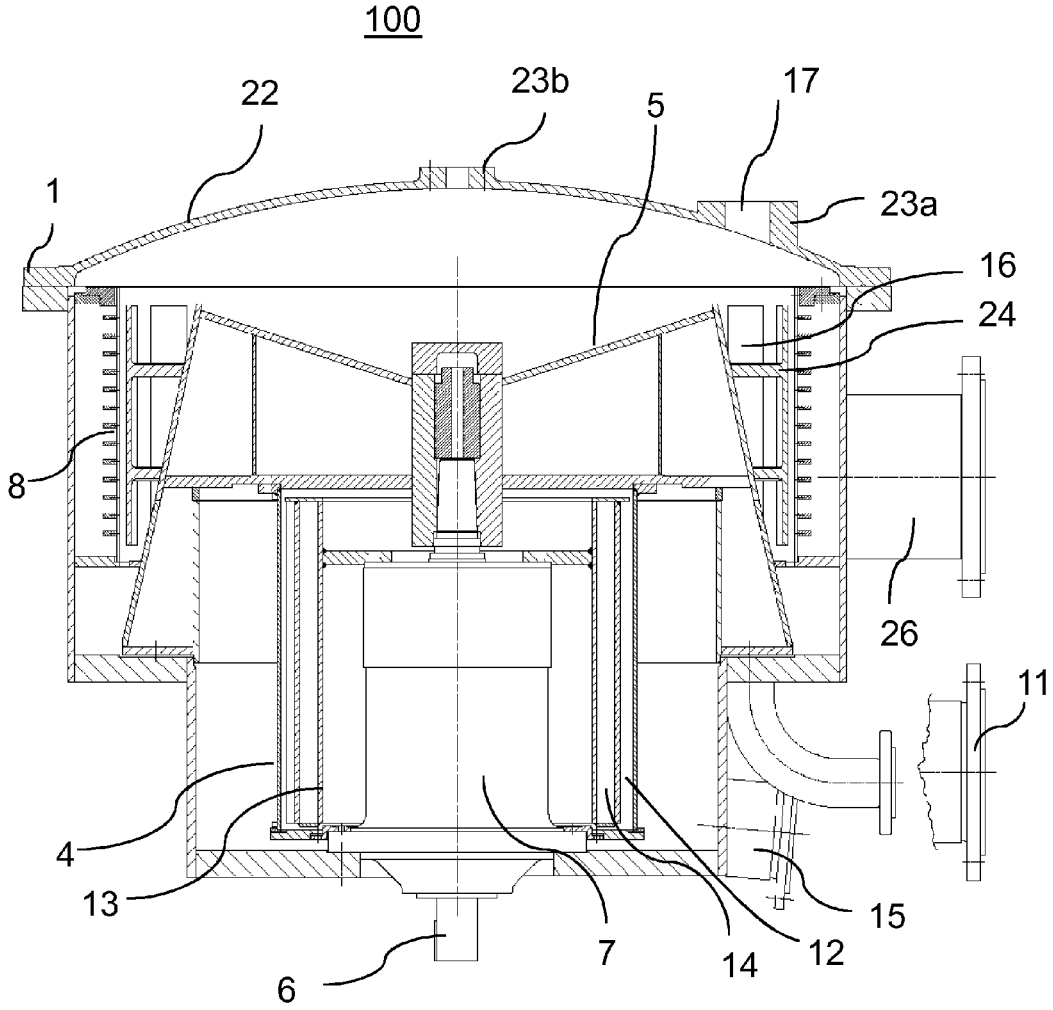
FIG. 3 is a side, elevational, schematic, cross-sectional view of an alternative embodiment of the screening arrangement of the present invention.

FIG. 3 shows a screening arrangement where the secondary pulp inlet 17 is located in the cover 22 of the screen housing 1. The accept from at least one subsequent screening arrangement is fed through the secondary pulp inlet 17 in the cover 22 of the screening housing 1 and enters the screening chamber 16. According to this illustrated embodiment, a connection piece 23*a* is arranged within the cover and pulp fed through the secondary pulp inlet 17 is mixed in the second screening chamber 16 mixed with the accept portion from the first accept chamber 12 flowing up through the rotor means 5. The rotor means is preferably arranged with rotor pulse means 24 in order to create suction pulses to clean the second screening means 8. Alternatively, a connection piece 23*b*, located in the center of the cover 22 may be used as a secondary pulp inlet 17. The location of the secondary pulp inlet 17 should be chosen to optimize mixing with the flow from the first accept chamber 12 in order to create a homogeneous flow to the second screening means 8.

Figure 4:
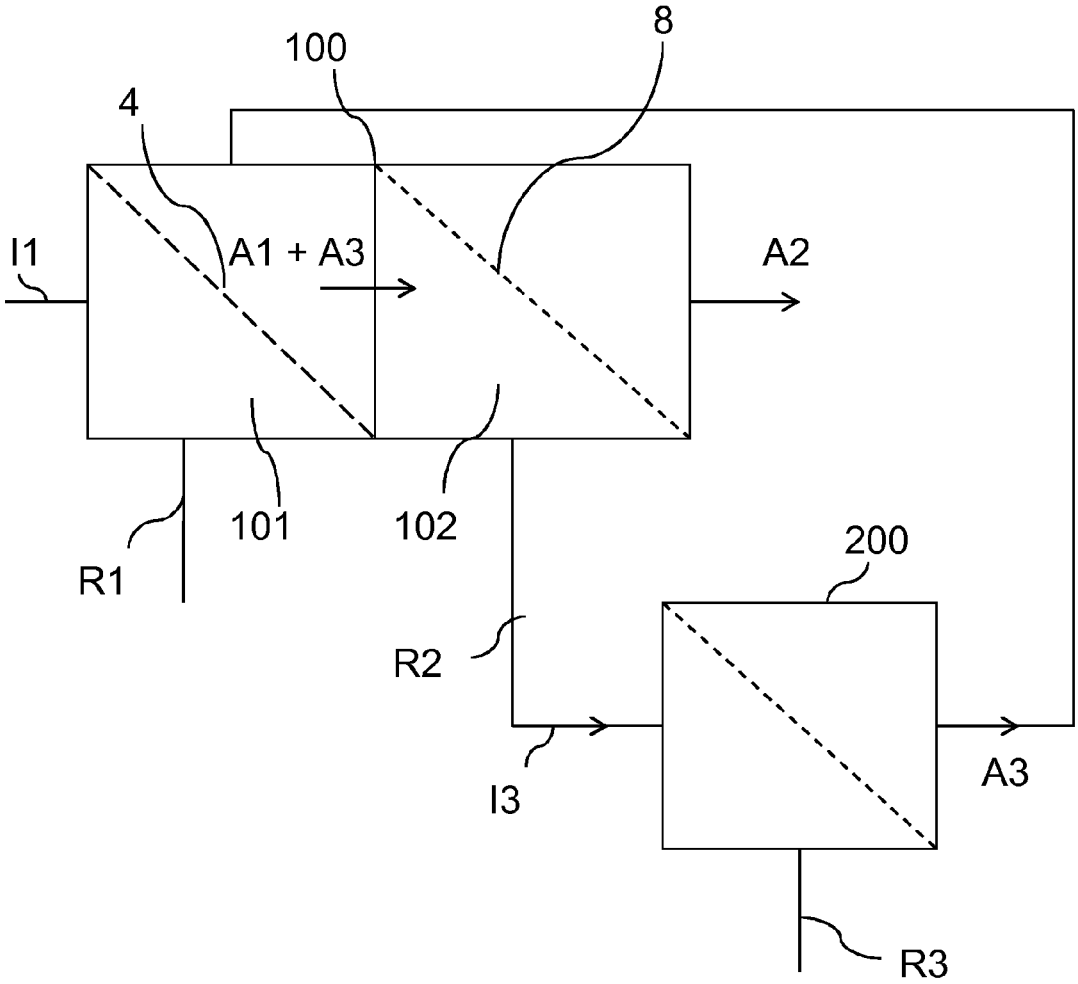
FIG. 4 is a diagrammatic block diagram of a screening system comprising a screening arrangement as illustrated in FIGS. 1-3.

FIG. 4 is a block diagram showing a system comprising two separate screening arrangements in which the first screening arrangement 100 is a combined screening arrangement comprising two screening stages, a first screening stage 101 and a second screening stage 102. Pulp is fed to the first screening arrangement as a first inject I1. In the first screening stage 101, pulp is separated into a first accept portion A1 and a first reject portion R1. The first reject portion R1 is taken out of the screening arrangement to be handled separately. The first accept portion A1 is fed within the first screening arrangement 100 to the second screening stage 102, where it is separated into a second accept portion A2 and a second reject portion R2. The second accept portion A2 is fed forward in the processing line to the next processing step. The system further comprises a second screening arrangement 200, which is arranged to follow subsequently upon the first screening arrangement 100, meaning that a reject portion R2 from the second screening stage 102 is fed as an inject 13 to the second screening arrangement 200. The second screening arrangement 200 is normally a screen with finer slots or holes than the second screening stage 102, or about the same. The pulp is in the second screening arrangement 200 separated into a third accept portion A3 and a third reject portion R3. According to the invention, the third accept portion A3 is returned to the first screening arrangement 100 and together with the first accept portion A1 fed as a second inject 12 (A1+A3) to the second screening stage 102.

Figure 5:
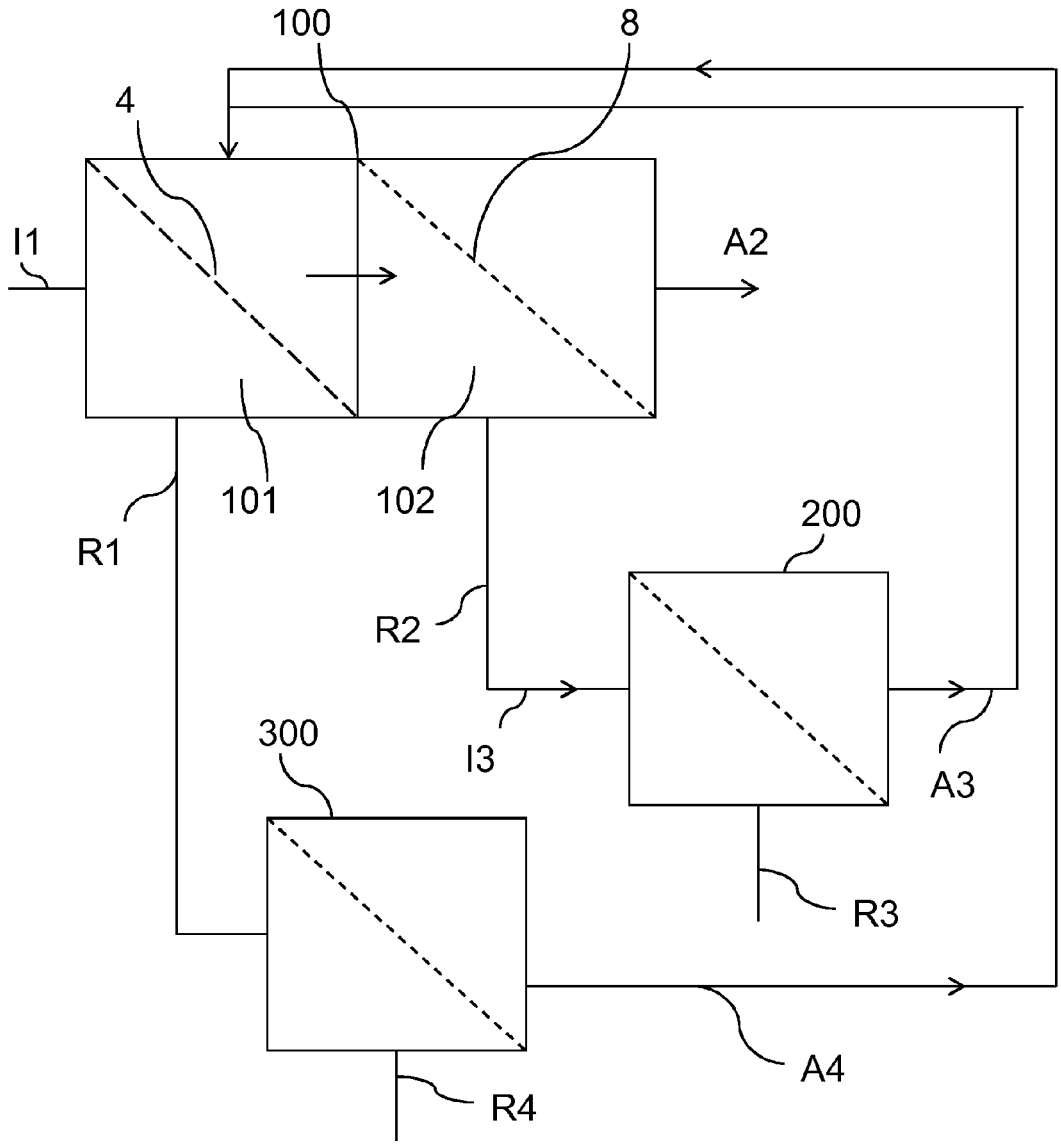
FIG. 5 is a diagrammatic block diagram of another screening system comprising a screening arrangement as illustrated in FIGS. 1-3.

FIG. 5 is a block diagram showing a system comprising three separate screening arrangements in which the first screening arrangement 100 is a combined screening arrangement comprising two screening stages. In this embodiment, accept may also be returned from a subsequent third screening arrangement 300. This screening arrangement is used to screen the reject portion R1 from the first screening stage 101 of the first screening arrangement 100. The reject portion R1 is thus divided into an accept portion A4 and a reject portion R4. The accept portion A4 may, as illustrated, be returned to the second screening stage 102 of the first screening arrangement 100. It is possible to return only the accept A4 from the third screening arrangement 300, excluding the accept A3 from the second screening arrangement 200, but more preferably both accepts A3 and A4 are returned to be screened through the second screening stage 102 of the first screening arrangement 100.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. Apparatus for screening a cellulose pulp stream comprising a housing, a first screen member contained within said housing including screen openings for permitting a first predetermined accept portion to pass therethrough and for crating a first reject portion, a second screening member contained within said housing including screen openings for permitting a second predetermined accept portion to pass therethrough and for creating a second reject portion, a primary inlet for directing said cellulose pulp stream into said housing, an accept outlet for withdrawing said second predetermined accept portion from said housing, a reject outlet for withdrawing at least one of said first and second reject portions from said housing, a first screening chamber for receiving said cellulose pulp stream from said primary inlet for transfer to said first screen member, a first accept chamber for receiving said first predetermined accept portion of said cellulose pulp stream which has passed through said first screen member, a second screening chamber for directing said first predetermined accept portion of said cellulose pulp stream from said first accept chamber to said second screen member, a secondary pulp inlet for receiving a second cellulose pulp feed stream comprising a screened cellulose pulp accept fraction and directing said second cellulose pulp feed stream to said second screen member, whereby said second predetermined accept fraction is delivered to said accept outlet.

2. The apparatus of claim 1 wherein said screen openings in said first screen member and said second screen member have different sizes.

3. The apparatus of claim 1 wherein said first and second screen members are coaxially disposed with each other in said housing, and said first screen member is rotatably mounted within said second screen member.

4. The apparatus of claim 1 wherein said screen openings in said first screen member comprise coarse screen openings and said screen openings in said second screen member comprise fine screen openings smaller than said coarse screen openings.

5. The apparatus of claim 1 wherein said second cellulose pulp feed stream merges with said first predetermined accept fraction before entering said second screen member.

6. The apparatus of claim 1 wherein said secondary pulp inlet is disposed in the lower portion of said housing.

7. The apparatus of claim 6 wherein said secondary pulp inlet is disposed in the largest diameter portion of said housing.

8. The apparatus of claim 1 including a secondary pulp inlet chamber for directing said secondary cellulose pulp feed stream from said secondary pulp inlet to said second screen member.

9. The apparatus of claim 8 wherein said secondary pulp inlet is disposed in the lower portion of said housing below said first screen member, whereby said secondary cellulose pulp feed stream flows from said secondary pulp inlet into said secondary pulp inlet chamber from below.

10. The apparatus of claim 8 including a bearing unit centrally disposed within said first screen member and a stator disposed between said first screen member and said bearing unit, said secondary pulp inlet chamber being disposed between said bearing unit and said stator.

11. The apparatus of claim 8 wherein said secondary pulp inlet chamber and said first accept chamber are connected to each other.

12. The apparatus of claim 1 wherein said secondary pulp inlet is disposed in the upper portion of said housing.

13. The apparatus of claim 12 wherein said housing includes a cover, and wherein said secondary pulp inlet is disposed in said cover.

14. A system including the apparatus of claim 1 and a separate housing including a third screen member for screening a separate cellulose pulp stream and producing a third accept portion thereby, and conduit means for passing said third accept portion to said secondary pulp inlet.

15. The apparatus of claim 14 wherein said secondary pulp inlet includes mixing means for mixing said third accept portion with said first predetermined accept portion for feeding into said second screen member.

16. A method for screening a cellulose pulp stream in a housing, including an inlet, a first screen member including screen openings for permitting a first predetermined accept portion to pass therethrough, and a second screen member, including screen openings permitting a second predetermined accept portion to pass therethrough, said method including directing said cellulose pulp stream into said inlet in said housing, directing said cellulose pulp stream from said inlet to said first screen member, screening said cellulose pulp stream in said first screen member to produce a first accept portion of said cellulose pulp stream and a first reject portion thereof, receiving said first accept portion of said cellulose pulp stream which has passed through said first screen member, screening said first accept portion of said cellulose feed stream in said second stream member to produce a second accept portion of said cellulose pulp stream and a second reject portion thereof, withdrawing said second accept portion from said housing, withdrawing at least one of said first and second reject portions from said housing, providing a second cellulose pulp feed stream comprising a screened cellulose pulp stream, and directing said second cellulose feed stream to said second screen member.

17. The method of claim 16 including mixing said second cellulose pulp feed stream with said first accept portion before screening in said second screen member.

* * * * *

UNITED STATES PATENT AND TRADEMARK OFFICE

CERTIFICATE OF CORRECTION

PATENT NO. : 8,303,769 B2
APPLICATION NO. : 13/256847
DATED : November 6, 2012
INVENTOR(S) : Andreas Engelfeldt, Bertil Ernerfeldt and David Lindkvist It is certified that error appears in the above-identified patent and that said Letters Patent is hereby corrected as shown below:

In the Specification

Column 3, line 58, after “also” insert --been--.
Column 5, line 6, delete “are” and insert therefor --is--.
Column 5, line 40, delete “an”.
Column 7, line 60, delete “is” and insert therefor --are--.

In the Claims

Column 10, line 9, delete “crat-” and insert therefor --creat- --.

Signed and Sealed this
Thirteenth Day of May, 2014

Michelle K. Lee

Michelle K. Lee
*Deputy Director of the United States Patent and Trademark Office*